US005114814A

United States Patent [19]

Sakoh et al.

[11] Patent Number: 5,114,814

[45] Date of Patent: May 19, 1992

[54] PHOTOSENSITIVE MEMBER FOR ELECTROPHOTOGRAPHY, IMAGE FORMING METHOD AND ELECTROPHOTOGRAPHIC APPARATUS USING THE SAME

[75] Inventors: Harumi Sakoh, Tokyo; Kiyoshi Sakai, Chofu; Shoji Amamiya, Sagamihara, all of Japan

[73] Assignee: Canon Kabushiki Kaisha, Tokyo, Japan

[21] Appl. No.: 680,797

[22] Filed: Apr. 3, 1991

Related U.S. Application Data

[63] Continuation of Ser. No. 253,082, Oct. 4, 1988, abandoned.

[30] Foreign Application Priority Data

Oct. 12, 1987 [JP] · Japan ..... 62-256769

[51] Int. Cl.[5] ..... G03G 5/043

[52] U.S. Cl. ..... 430/46; 430/126; 355/299

[58] Field of Search ..... 430/42, 45, 58, 106.6, 430/126, 46; 355/299

[56] References Cited

U.S. PATENT DOCUMENTS 3,992,091 11/1976 Fisher ..... 355/15
4,535,048 8/1985 Inoue et al. ..... 430/110
4,675,268 6/1987 Kishi et al. ..... 430/126
4,693,951 9/1987 Takasu et al. ..... 430/31
4,766,048 8/1988 Hisamura ..... 430/58

FOREIGN PATENT DOCUMENTS 53-92133 8/1978 Japan .
56-144433 11/1981 Japan .
60-263956 12/1985 Japan .
61-251859 11/1986 Japan .

*Primary Examiner*—John Goodrow
*Attorney, Agent, or Firm*—Fitzpatrick, Cella, Harper & Scinto

[57] ABSTRACT

There are provided a photosensitive member for electrophotography having a good cleaning characteristic when used in combination with a non-magnetic toner and a process speed of 80 mm/sec or larger, and an image forming method and an electrophotographic apparatus using the same. The photosensitive member has an average surface roughness of 0.3 to 5.0 microns and is suitably used in an electrophotographic apparatus including cleaning means comprising an elastomeric blade, and developing means for using a two-component developer which comprises a dry non-magnetic toner comprising a binder resin having a glass transition point of 60° C. or below.

15 Claims, 1 Drawing Sheet

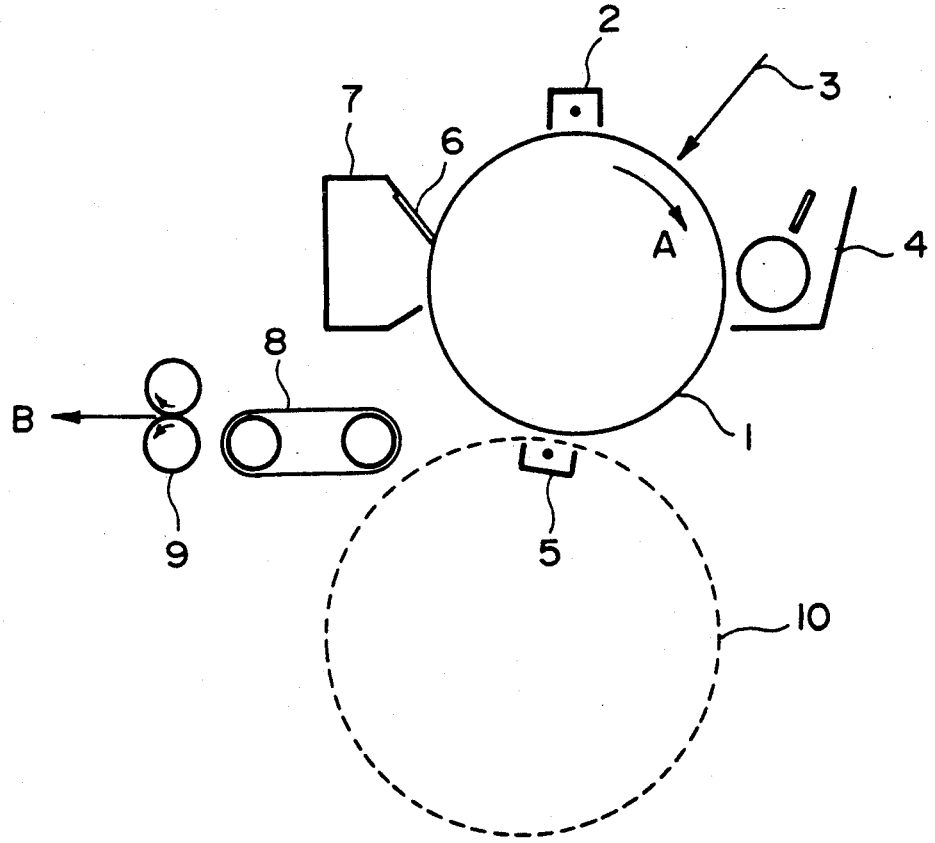
2
3
7
6
A
4
8
B
1
9
5
10

PHOTOSENSITIVE MEMBER FOR ELECTROPHOTOGRAPHY, IMAGE FORMING METHOD AND ELECTROPHOTOGRAPHIC APPARATUS USING THE SAME

This application is a continuation of application Ser. No. 07/253,082 filed Oct. 4, 1988 now abandoned.

FIELD OF THE INVENTION AND RELATED ART

The present invention relates to a photosensitive member for electrophotography, particularly to a photosensitive member for electrophotography having a good cleaning characteristic when used in combination with a non-magnetic toner, and an image forming method and an electrophotographic apparatus using the same.

There have heretofore been known photosensitive members for electrophotography using as a photosensitive element an inorganic photoconductor such as selenium, cadmium sulfide, or zinc oxide.

These photoconductor materials have many advantages such that they can be charged to an appropriate potential in a dark place, slowly diffuse the resultant charge in a dark place, and can rapidly diffuse the charge when subjected to light exposure. On the other hand, these inorganic photoconductor materials have various disadvantages.

For example, a selenium photosensitive member has disadvantages such that it easily promotes crystallization under the action of various factors such as temperature, humidity, dust and pressure, particularly at an environmental temperature of above 40° C., thereby to cause a decrease in its chargeability and to cause white spots in the resultant copy image.

Further, a cadmium sulfide photosensitive member has a disadvantage such that it cannot have stable sensitivity under a high humidity condition. Moreover, a zinc oxide photosensitive member requires sensitization due to a sensitizer coloring matter represented by rose bengal. Since such sensitizer coloring matter causes chargeability deterioration due to charging or light-fading due to exposure light, the zinc oxide photosensitive member has a disadvantage such that it cannot provide stable images for a long period.

On the other hand, it has been discovered that specific classes of organic compounds have shown photoconductivity. For example, there have been known organic photoconductors including organic photoconductive polymers such as poly-N-vinylcarbazole and poly-vinylanthracene; low-molecular weight organic photoconductors such as carbazole, anthracene, pyrazolines, oxadiazoles, hydrazones, and polyarylalkanes; and organic pigments and dyes such as phthalocyanine pigments, azo pigments, cyanine dyes, polycyclic quinone pigments, perylene pigments, indigo dyes, thioindigo dyes and squaric acid methine dyes.

Especially, as organic pigments or dyes having photoconductivity can easily be synthesized as compared with inorganic materials and can be flexibly selected so as to show photoconductivity in a desired wavelength region, a large number of organic pigments or dyes have been proposed. For example, it has been proposed to use disazo pigment showing photoconductivity as a charge generating material in a photosensitive layer which has been functionally separated into a charge generation layer and a charge transportation layer as disclosed by U.S. Pat. Nos. 4123270, 4251613, 4251614, 42566821, 4260672, 4268596, 4278747, and 4293628.

A photosensitive member for electrophotography may be used by incorporating it in an electrophotographic apparatus which at least comprises charging means, image exposure means, developing means, transfer means, and cleaning means. The developing process to be used in such apparatus includes a wet process and a dry process. Among these, the wet developing process using a developing liquid has disadvantages such that it requires a specially prepared paper and has poor stability with respect to the liquid developer concentration, etc. Accordingly, at present, there is mainly used the dry developing process free of these disadvantages.

The dry developing process includes a one-component developing process using a magnetic toner, and a two-component developing process using a non-magnetic toner. In the two-component developing process, a two-component developer comprising a toner and a magnetic carrier is held on the surface of a developer-carrying member such as a cylindrical sleeve containing therein a magnet and is disposed in the form of a brush under the action of the resultant magnetic field. When the magnetic brush thus formed contacts the surface of the photosensitive layer having an electrostatic latent image, the toner in the brush is attracted to the electrostatic latent image to develop the latent image.

On the other hand, the one-component developing process uses a magnetic toner. Since the magnetic toner particles per se contain a magnetic material, they have considerable hardness and are liable to abrade or grind the photosensitive member surface. Therefore, the contact area between the photosensitive member and a cleaning member decreases, fine developer particles get into the clearance or gap between the photosensitive member surface and the cleaning member, and the resultant shavings produced by the abrasion of the photosensitive member also functions as a lubricant, whereby the lubricity between the photosensitive member surface and the cleaning member increases. However, since the magnetic toner contains the magnetic material, it only provides a somber color when caused to have a color other than black. Accordingly, it is difficult to use the magnetic toner for color copying. As a result, a nonmagnetic toner must be used in order to effect development for color copying.

Incidentally, in any of the above-mentioned developing processes, there is required a cleaning step for removing a residual toner remaining on the photosensitive member surface after a transfer step, in order to effect an electrophotographic process using a dry toner.

The cleaning method generally includes a blade cleaning method and a fur brush cleaning method, as described below. In the blade cleaning method, an elastomeric or rubber member, i.e., so-called "blade", is caused to contact a photosensitive member under pressure to obviate the clearance between the photosensitive member and the blade, whereby toner particles attached to the photosensitive member surface are prevented by the blade from passing through the clearance between the blade and the photosensitive member surface. On the other hand, in the fur brush cleaning method, a roller comprising a fur brush is rotated while contacting a photosensitive member surface, whereby toner particles attached thereto are wiped off or tapped off.

In the latter fur brush cleaning method, the toner particles are liable to pass through the clearance between the fur brush and the photosensitive member surface unless the fur brush is caused to strongly contact the photosensitive member. Further, when toner particles accumulated on the fur brush are fused, they are liable to damage the photosensitive member. Moreover, since the rubber blade is more inexpensive than the fur brush, the blade cleaning method is mainly used at present. Particularly, in the case of development for natural color (or multi-color) copying, the natural colors are provided by superposing images comprising three primary colors of magenta, cyan and yellow (or four colors further comprising black), and therefore the amount of the toner used in such development is much larger than that used in the development for mono-color copying. Accordingly, in such multi-color development, it is most preferred to use the blade cleaning method wherein a rubber blade is caused to contact a photosensitive member under pressure.

Conventionally, in a case where a wet-type toner is subjected to cleaning step using a cleaning blade, there occurs no problem since the wet-type toner particles comprise fine particles and they get into the clearance between the cleaning blade and the photo-sensitive member surface thereby to function as a lubricant. Further, in a case where a dry magnetic toner is subjected to cleaning step using the cleaning blade, there occurs no problem since the magnetic toner particles per se have excellent abrasiveness to the photosensitive member surface as described hereinabove.

However, in a case where a non-magnetic toner is used in order to obtain a multi-color image, etc., the abrasiveness thereof to abrade a photosensitive member surface is 1/10 times or below that of the magnetic toner. Further, magnetic particles (carrier particles) used in combination with the non-magnetic toner comprise iron or ferrite powder, or that coated with a resin, and they only brush the photosensitive member surface at the time of development. As a result, the dry two-component developing system has an abrasiveness to abrade the photosensitive member surface of about ⅓ times that in the dry one-component developing system. Accordingly, the abrasiveness in the two-component developing system is insufficient, and when image formation is effected repeatedly, there are liable to occur phenomena such that the cleaning blade is reversely bent toward the moving direction of the photosensitive member (hereinafter, such phenomenon is sometimes referred to as "reverse of a blade") and image failure such as image staining and image defect occurs.

Heretofore, such case has somehow been handled, e.g., by sprinkling a lubricant such as polyvinylidene fluoride powder on a photosensitive member at an initial stage in use thereof or by adding a lubricant to the developer. Incidentally, the above-mentioned phenomenon remarkably occurs, particularly when the natural or multi-color development is used. More specifically, in this case, the cleaning blade is reversely bent even at the initial stage in successive use to stop the movement of the photosensitive member, or the edge portion of the blade is torn and broken off due to friction.

SUMMARY OF THE INVENTION

An object of the present invention is to provide an image forming method and an electrophotographic apparatus capable of preventing cleaning failure caused by reverse of a cleaning blade, breakage of the edge portion thereof, etc., in an electrophotographic process, and an electrophotographic photosensitive member used in such electrophotographic process.

Another object of the present invention is to provide an image forming method and an electrophotographic apparatus capable of suppressing image staining, image defect and cleaning failure in an electrophotographic process using a color toner, and an electrophotographic photosensitive member used in such electrophotographic process.

A further object of the present invention is to provide an image forming method and an electrophotographic apparatus capable of suppressing cleaning failure and providing a good successive copying characteristic in an electrophotographic process using color toners of three or four colors to effect natural or full-color development, and an electrophotographic photosensitive member used in such electrophotographic process.

According to the present invention, there is provided an image forming method, comprising the steps of: providing an electrophotographic photosensitive member having an average surface roughness of 0.3 to 5.0 microns and rotating at a process speed of 80 mm/sec or larger; charging the photosensitive member; exposing the photosensitive member imagewise corresponding to image information thereby to form thereon an electrostatic latent image; developing the electrostatic latent image with a two-component developer which comprises a dry non-magnetic toner comprising a binder resin having a glass transition point of 60° C. or below, and magnetic material coated with a resin, thereby to form a toner image on the photosensitive member; transferring the toner image onto a transfer-receiving material; and removing the residual toner remaining on the photosensitive member by an elastomeric blade thereby to clean the photosensitive member.

The present invention also provides an electrophotographic apparatus comprising: a photosensitive member having an average surface roughness of 0.3 to 5.0 microns and being rotatable at a process speed of 80 mm/sec or larger, charging means for charging the photosensitive member; image exposure means for exposing the photosensitive member corresponding to image information thereby to form an electrostatic latent image thereon; developing means for developing the latent image by using a two-component developer which comprises a dry non-magnetic toner comprising a binder resin having a glass transition point of 60° C. or below, and magnetic material coated with a resin, thereby to form a toner image on the photosensitive member; transfer means for transferring the toner image onto a transfer-receiving material; and cleaning means for removing the residual toner remaining on the photosensitive member by an elastomeric blade; wherein the charging means, image exposure means, developing means, transfer means and cleaning means are disposed in this order along the moving direction of the photosensitive member.

The present invention further provides a photosensitive member for electrophotography to be used in an electrophotographic apparatus including cleaning means comprising an elastomeric blade, and developing means for using two-component developer which comprises a dry non-magnetic toner comprising a binder resin having a glass transition point of 60° C. or below, and magnetic material coated with a resin; the photosensitive member being adapted to an electrophotographic process having a process speed of 80 mm/sec or larger; the photosensitive member having an average surface roughness of 0.3 to 5.0 microns.

These and other objects, features and advantages of the present invention will become more apparent upon a consideration of the following description of the preferred embodiments of the present invention taken in conjunction with the accompanying drawings.

BRIEF DESCRIPTION OF THE DRAWING

The sole figure is a schematic side view of an embodiment of the electrophotographic apparatus according to the present invention, which shows an electrophotographic photosensitive member and means for effecting an electrophotographic process disposed around the photosensitive member.

DETAILED DESCRIPTION OF THE INVENTION

Hereinbelow, the present invention will be described in detail with respect to an embodiment thereof using a dry toner unless otherwise noted specifically.

There may be considered as follows a cleaning mechanism wherein an elastomeric blade such as a rubber blade is caused to contact a photosensitive member under pressure thereby to remove residual toner particles attached to the photosensitive member, while preventing reversal of the blade, etc.

Fine particles slightly contained in a toner which have a particle size of 5.0 microns or smaller, and/or shavings produced from the photosensitive member surface by abrasion in use thereof which have a particle size of about 1.0 micron or smaller may get into the clearance between the photosensitive member and the blade, and these particles function as a lubricant just like balls constituting a ball-bearing. As a result, the above-mentioned particles reduce the friction between the photosensitive member surface and the cleaning blade, while most of the toner particles having a relatively large particle size (larger than 5.0 microns) are removed by the blade. The above-mentioned shavings produced from the photosensitive member surface are more easily produced as the photosensitive member surface is rougher.

Each of known lubricants such as polyvinylidene fluoride powder or zinc stearate powder is generally used so that it has a particle size of 2.0 microns or below. Accordingly, it is considered that these lubricants may enhance the lubricity by the above-mentioned mechanism.

As a result, it is considered that the friction between the photosensitive member surface and the cleaning blade can be reduced more easily and suitable cleaning can be conducted more easily, as the photosensitive member surface has a larger surface roughness or is more liable to be abraded.

According to our knowledge, the mechanism of roughening a photosensitive member surface may be classified into three kinds as follows.

(1) A mechanism wherein residual toner particles remaining on a photosensitive member after a transfer step are accumulated at a cleaning blade position, and the toner particles sandwiched between the blade and the photosensitive member surface abrade the photosensitive member surface to roughen it.

In the case of a one-component developing system using a magnetic toner, the above-mentioned residual toner particles after the transfer step comprise the magnetic toner particles per se. On the other hand, in the case of a two-component developing system using a non-magnetic toner, the residual toner particles only comprise soft toner particles containing no magnetic material. Because the magnetic material generally comprises iron powder or ferrite powder, and the magnetic toner particles contain such magnetic material, they have a high hardness and a very high abrasiveness. However, the toner particles for the two-component non-magnetic developing system comprise a soft resin, and therefore such toner particles have only a low hardness and an abrasiveness of 1/10 or below that of the magnetic toner.

(2) A mechanism wherein, in the case of a two-component developing system using a non-magnetic toner, magnetic particles (carrier) disposed on a developing sleeve abrade a photosensitive member surface by brushing to roughen it.

As the magnetic particles disposed on the developing sleeve, iron powder having a flaky or spherical shape has conventionally been used. However, at present, ferrite powder, etc., coated with a resin are used in order to easily design the stirrability in a developing apparatus, particle size, electric characteristics, etc. Therefore, the resin-coated magnetic particles presently used have a lower abrasiveness than that of the conventional iron powder with respect to the abrasion of the photosensitive member surface. As a result, the two-component developing system using the resin-coated magnetic particles has an abrasiveness with respect to a photosensitive member surface of about ⅓ that of the one-component developing system.

(3) A mechanism wherein a cleaning blade per se abrades a photosensitive member surface to roughen it.

The cleaning blade alone can abrade the photosensitive member surface to a certain extent, but it has abrasiveness of 1/10 or below that in the presence of a magnetic toner. Accordingly, the blade alone slightly roughens the photosensitive member surface.

For the reason as described above, a magnetic toner is liable to roughen a photosensitive member surface. Accordingly, in a case where the magnetic toner is used, there occurs no problem with respect to reverse of a blade, etc., if a lubricant is imparted to the photosensitive member surface (or added to a developer) only at an initial stage at which the photosensitive member surface is not roughened yet.

However, in a case where a non-magnetic toner is used in order to effect color copying, the nonmagnetic toner has a poor abrasiveness to a photosensitive member surface, and particularly when natural or full-color development is conducted, the friction between the blade and the photosensitive member surface is increased. Accordingly, when a lubricant is simply applied to the photosensitive member at an initial stage in use thereof, the resultant lubricating effect decreases before the photosensitive member surface per se is roughened to have an increased lubricity, whereby the reverse of the cleaning blade, etc., are caused.

The reason for such phenomenon may be because the natural color development process uses the dry two-component developing system, it has a poor abrasiveness to a photosensitive member surface as described above. Further, it may be considered that the following reasons are added to the above-mentioned reason.

(1) In order to obtain one copy sheet, three primary color toners of magenta, cyan and yellow (or four color toners further comprising a black toner) are used, and three or four developing operations are required. As a result, a process speed, i.e., peripheral speed of a photosensitive member of 80 mm/sec or higher is required, and the friction applied to a cleaning blade is increased.

(2) Because the three or four color toners transferred to a transfer-receiving material such as paper must be fixed thereto so that they are sufficiently fused and mixed, the toners are required to have a glass transition temperature (Tg) of 60° C. or below. As a result, the agglomerative ability and adhesiveness of the toner particles become high, but there is reduced the function thereof as a lubricant which has heretofore enhanced the lubricity between the cleaning blade and the photosensitive member surface by causing the toner particles to get into the clearance therebetween.

The above-mentioned reverse of the cleaning blade and breakage of the edge portion thereof are further liable to occur particularly when the photosensitive member surface is made harder, i.e., made more difficult to be abraded, in order to lengthen the life of the photosensitive member. Further, when the particle sizes of the toner particles are uniformized and fine toner particles are removed therefrom in order to enhance the image quality, there is further reduced the lubricity which is caused by the toner particles when they get into the clearance between the cleaning blade and the photosensitive member. As a result, the reverse of the cleaning blade and breakage of the edge portion thereof are furthermore liable to occur.

On the basis of the above-mentioned knowledge, in the present invention, the surface of a photosensitive member is preliminarily roughened to a specific extent, whereby cleaning failure due to reverse of a cleaning blade and breakage of the edge portion thereof, etc., is prevented without inviting a decrease in image quality.

In the present invention, the average surface roughness of a photosensitive member is 0.3 micron to 5.0 microns, preferably 0.3 micron to 2.0 microns, in terms of an average of ten measured values of surface roughness Rz (JIS-B0601), which is an average value with respect to 16 directions. If the average surface roughness is larger than 5.0 microns, an image defect in the form of streak appear in the resultant image when the photosensitive member surface is further roughened by repetitive copying. Even in a case where the average surface roughness is larger than 2.0 microns and not larger than 5.0 microns, when the photosensitive member is repeatedly used under very unfavorable state with respect to environment and conditions, an image defect in the form of a streak can also appear in the resultant image. If the average surface roughness is 2.0 microns or smaller, the friction between the cleaning blade and the photosensitive member surface is sufficiently small, and no image defect occurs even in repetitive use.

On the other hand, the average surface roughness is smaller than 0.3 micron, the friction between the cleaning blade and the photosensitive member surface is little reduced, and shavings from the photosensitive member surface are hardly produced because the photosensitive member surface is flat. As a result, the roughening of the photosensitive member surface cannot produce a recognizable effect. However, the average surface roughness is 0.3 micron or larger, the friction between the cleaning blade and the photosensitive member surface is sufficiently reduced, and shavings from the photosensitive member surface are easily produced, whereby problems such as reverse of the cleaning blade do not occur.

As described above, in the present invention, cleaning failure such as reverse of a cleaning blade and breakage of the edge portion thereof is prevented by causing the photosensitive member surface to have an average surface roughness of 0.3 micron to 0.5 micron.

On the other hand, if the abrasion characteristic or scrapability of a photosensitive member surface is less than 2.0 measured according to a Taber's abrasion test, the photosensitive member is difficult to be abraded or scraped and is very difficult to be roughened, whereby problems such as the reverse of a cleaning blade are liable to occur.

The "abrasion characteristics" used herein is defined as an "abrasion weight loss" measured by the Taber's abrasion test. More specifically, a Taber's abrasion tester according to JIS K-7204 (mfd. by Yasuda Seiki Seisakusho K. K.) is used, and a photosensitive member (sample) is caused to make 5,000 rotations while a load of 500 g is applied thereto by using a lapping tape (C-2000, mfd. by Fuji Photo Film K. K.). If an abrasion weight loss of, e.g., 2.0 mg is obtained in such measurement, the abrasion characteristic is represented by "2.0".

If the above-mentioned abrasion characteristic is 2.0 or larger, the photosensitive member is liable to be roughened by repetitive use. Particularly, when the initial average surface roughness of the photosensitive member surface is 0.3 micron to 5.0 microns, problems such as reverse of the cleaning blade are further less liable to occur. Accordingly, in the present invention, the abrasion characteristic of the photosensitive member surface may preferably be 2.0 or larger according to the Taber abrasion test.

In a case where fine particles are removed from toner particles and the particle size thereof is uniformized in order to prevent scattering caused by the fine toner particles or to particularly attain high clearness required for a color copy image, there is reduced the lubricating effect due to the toner per se, which has heretofore been accomplished by the fine toner particles getting into the clearance between the cleaning blade and the photosensitive member surface. As a result, the friction therebetween cannot be reduced.

However, when toner particles having a particle size of 5.0 microns or below are contained in the toner in an amount of 5.0% by number or more, the fine toner particles function as a lubricant, whereby problems such as reverse of a cleaning blade and breakage of the edge portion thereof do not occur. Incidentally, very fine toner particles having a particle size of 0.1 micron or less hardly function as a lubricant, because they pass through the clearance between the cleaning blade and the photosensitive member surface.

Accordingly, a toner may preferably comprise 5.0% by number or more of toner particles having a particle size of 5.0 microns or less in the particle size distribution thereof, in order to more effectively prevent problems such as reverse of a cleaning blade without inviting image staining.

On the other hand, in a case where a cleaning blade is caused to contact a photosensitive member under pressure, if the line pressure of the cleaning blade is larger than 30.0 g/cm, the friction between the cleaning blade and the photosensitive member surface becomes too large, whereby problems such as reverse of a cleaning blade and breakage of the edge portion thereof are liable to occur. If the above line pressure is smaller than 5.0 g/cm, fine toner particles, which are capable of getting into the clearance of the cleaning blade and the photosensitive member surface to function as a lubricant, pass through the clearance in a large amount, and then are transferred to a transfer-receiving material such as paper in the next transfer step, whereby they appear as image staining in the resultant image. Accordingly, the line pressure applied from the cleaning blade to the photosensitive member may preferably be 5.0 g/cm to 30.0 g/cm, more preferably 6–15 g/cm, in order to prevent the above-mentioned problems such as reverse of a cleaning blade and breakage of the edge portion thereof, and cleaning failure. The "line pressure" of a cleaning blade used herein is a value obtained by dividing the total load (g) applied to the blade, by the total length (cm) in which the blade contacts the photosensitive member surface.

Hereinabove, there is described the prevention of reverse of a cleaning blade, breakage of the edge portion thereof, and cleaning failure. Further, the average surface roughness of a photosensitive member surface may more preferably be 0.5 micron or less, when measured in the direction of the movement of the photosensitive member.

The reason for this may be considered as follows.

A cleaning blade generally contacts a photosensitive member surface so that the longitudinal direction of the cleaning blade is perpendicular to the movement direction of the photosensitive member. Accordingly, with respect to the roughening, only the grooves perpendicular to the cleaning blade, i.e., those appearing in the direction of the movement of the photosensitive member, have an effect on a reduction in friction. Further, in a case where the photosensitive member has a surface roughness of above 0.5 micron in the direction of the movement thereof, i.e., the photosensitive member has grooves parallel to the cleaning blade, the blade is liable to scrape protrusions or convexities disposed between the grooves, whereby the photosensitive member is excessively abraded to shorten the life thereof. If the surface roughness of the photosensitive member in the direction of movement thereof is suppressed to 0.5 micron or smaller, the life of the photosensitive member with respect to scraping may remarkably be lengthened as compared with that in the case of the surface roughness of above 0.5 micron.

In order to roughen a photosensitive member surface, there may be used a mechanical abrasion method using an abrasive or sandblasting. In addition, there may be used a method wherein the surface is made orange peel-like by controlling drying conditions at coating, a method wherein the surface is subjected to a solvent, or a method wherein a coating liquid for a surface layer to which powder particles have preliminarily been added, is applied onto a substrate to form the surface layer having a rough surface etc.

Among these methods, the mechanical abrasion method is most preferred in order to enhance the lubricity between the cleaning blade and the photosensitive member surface, because the shavings produced by the mechanical abrasion function as a lubricant as such. Accordingly, a photosensitive member produced by mechanical abrasion can have a sufficient lubricating effect, even when the photosensitive member has a lower surface roughness than that without mechanical abrasion.

In the above-mentioned mechanical abrasion, the photosensitive member surface may preferably be rubbed with a lapping tape. The "lapping tape" used herein refers to a material comprising a polymer film and abrasive particles disposed thereon. The abrasive particles may preferably be applied onto the polymer film by coating or bonded thereto.

Hereinbelow, an embodiment of the electrophotographic apparatus and the image forming method according to the present invention will be described with reference to a schematic sectional view of the accompanying drawing.

Referring to the figure, the electrophotographic apparatus basically comprises: a cylindrical electrophotographic photosensitive member 1, and around the photosensitive member 1, a charger 2 for charging the photosensitive member 1, an image exposure unit (not shown) for providing a light beam 3 to form a latent image on the photosensitive member 1, a developing apparatus 4 for developing the latent image with a toner (not shown) to form a toner image, a transfer charger 5 for transferring the toner image from the photosensitive member 1 onto a transfer-receiving material such as paper (not shown), a conveyer belt 8 for conveying the transfer material onto which the toner image is transferred, to a fixing apparatus 9, and a cleaner 7 having a cleaning blade 6 for removing the residual toner.

In an electrophotographic process using the apparatus shown in the figure, the photosensitive member 1 rotating in the direction of an arrow A is first charged by the charger 2 and the photosensitive member is supplied with charges. Then, the light beam 3 corresponding to image information based on an original image is supplied to the photosensitive member 1 from the image exposure means, thereby to form an electrostatic latent image on the photosensitive member 1. The latent image is then developed with a two-component developer which comprises a dry non-magnetic toner and magnetic particles (carrier) coated with a resin and is contained in the developing apparatus 4, thereby to form a toner image on the photosensitive member 1. The toner image is transferred to a transfer-receiving material such as paper by means of the transfer charger 5, and the residual toner remaining on the photosensitive member 1 is removed by means of the cleaner 7 by scraping it off by the cleaning blade 6. On the other hand, the transfer-receiving material is conveyed in the direction of an arrow B by the conveyer belt 8 to the fixing apparatus 9, whereby the toner disposed on the transfer-receiving material is fixed thereto.

In the above-mentioned electrophotographic process, a halogen lamp, a fluorescent lamp, a laser, etc., may be used as the image exposure means. Further, as an auxiliary process, a pre-exposure may be effected before the charging due to the charger 2, or pre-transfer exposure may be effected before the transfer due to the transfer charger 5.

In a case where a natural full-color copying is effected by using such electrophotographic process, basically, a copy image may be formed by repeating the above-mentioned steps of charging, image exposure, developing, transfer and cleaning three or four times. In such case, there may be provided, at the developing step, three developing apparatus respectively containing cyan, magenta and yellow toners, or four developing apparatus respectively containing these three primary color toners and a black toner. These three or four developing apparatus may be disposed so that they are movable corresponding to the rotation of the photosensitive member 1. In the development for each color, the development may be effected so that the developing apparatus corresponding to the color is disposed at the position of the developing apparatus 4 shown in the figure. Incidentally, these three or four developing apparatus may also be fixed so that they are disposed successively around the peripheral surface of the photosensitive member 1.

On the other hand, at the transfer step, a toner image formed on the photosensitive member 1 may be transferred onto a transfer-receiving material such as paper wound around a transfer drum 10 (dotted line) as shown in the figure with respect to each of the above three or four colors, so that these color toner image are superposed successively on the transfer-receiving material. The transfer-receiving material is then conveyed to the fixing apparatus 9 by the conveyer belt 8, and the respective color toners disposed on the transfer-receiving material are fused by heat and mixed with each other, whereby a natural full-color copy image corresponding to the original image may be obtained.

Incidentally, in a case where the transfer drum 10 is not used in the above-mentioned transfer step, the transfer steps corresponding to respective colors are not effected, but the cleaning blade 6 may be caused not to contact the photosensitive member 1 and respective toner images of three or four colors may be superposed on the photosensitive member 1 to form a multi-color toner image thereon, which is finally transferred onto a transfer-receiving material.

In the present invention, the process speed of the photosensitive member 1 is 80 mm/sec or larger. The "process speed" used herein refers to the peripheral speed of the photosensitive member.

In the present invention, the electrophotographic photosensitive member may preferably comprise an electroconductive substrate and a photosensitive layer disposed thereon. The photosensitive layer may preferably comprise a laminate-type organic photosensitive layer which is functionally separated into a charge generation layer containing a charge-generating substance, and a charge transport layer containing a charge-transporting substance. The charge transport layer may preferably be disposed on the charge generation layer.

The charge generation layer may be formed by dispersing a charge-generating substance such as phthalocyanine pigment, quinone pigment, azo pigment, pyranthrone pigment, and anthanthrone pigment, in an appropriate binder resin such as polyvinyl butyral, polystyrene, acrylic resin and polycarbonate. The charge generation layer may also be formed as a vapor deposition layer by using a vacuum vapor deposition apparatus. The charge generation layer may preferably have a thickness of 5 microns or below, more preferably 0.05–2 microns. The ratio of the binder to the charge-generating substance may preferably be 1:6 to 8:1.

The charge transport layer may preferably comprise an appropriate binder resin such as polyester, polystyrene, acrylic resin and polycarbonate, and a charge-transporting substance contained therein such as hydrazone compound, pyrazoline compound oxazole compound and styryl compound. The charge transport layer may preferably have a thickness of 5–40 microns, more preferably 10–30 microns. The ratio of the binder to the charge-transporting substance may preferably be 1:6 to 10:1.

In the present invention, the photosensitive layer constituting the photosensitive member may also comprise a single layer comprising both of the above-mentioned charge-generating substance and charge-transporting substance, which are contained in the above-mentioned binder resin.

In view of a suitable surface roughness and a suitable abrasion characteristic of the photosensitive member, basically, the surface layer of the photosensitive member according to the present invention may preferably comprise a coating layer at least comprising a binder resin as a predominant component, particularly a polycarbonate resin.

The electroconductive substrate constituting a photosensitive member may comprise a cylindrical member, a film, a sheet, etc., of a material including metals such as aluminum, aluminum alloy and stainless steel, and papers, plastics, etc.

Further, there may be diposed an intermediate layer such as electroconductive layer, adhesive layer and undercoat layer between the electroconductive layer and the photosensitive layer, in order to cover the surface defect of the substrate, or to improve charge injection characteristic, adhesion strength, etc., of the photosensitive member.

The non-magnetic toner used in the present invention comprise a binder resin having a glass transition point of 60° C. or below. Such binder resin may preferably comprise a styrene-type resin, a polyester resin, etc., particularly a polyester resin. In order to prepare a color toner of magenta, cyan or yellow, etc., 15 wt. parts or less of a colorant of a pigment or dye may preferably be contained in 100 wt. parts of the above-mentioned binder resin.

The magnetic material (carrier) used in the present invention may be composed of, e.g., iron or an alloy of iron with nickel, copper, zinc, cobalt, manganese, chromium, and rare earth elements in the surface oxidized form or in the surface non-oxidized form, or of an oxide or ferrite form of these metal or alloys.

In order to coat the surface of the magnetic material with a resin, any known process may be used. For example, the carrier may be coated with a resin by dipping the carrier in a solution or suspension of the resin or attaching the resin in powder form to the carrier.

The resin on the carrier surface may, for example, be polytetrafluoroethylene, monochlorotrifluoroethylene polymer, polyvinylidene fluoride, silicone resin, polyester resin, styrene-type resin, acrylic resin, polyamide, polyvinyl butyral, aminoacrylate resin, etc. Such resin may preferably be used in an amount of 0.1–10 parts per 100 wt. parts of the magnetic material. These coating material may be used singly or in combination. However, the resin used in the present invention should not be restricted to the above-mentioned resin.

In the present invention, the carrier may preferably have a paraticle size of 30–150 microns. The toner may preferably be used in an amount of 1–15 wt. parts per 100 wt. parts of the carrier.

Further, in order to stabilize the charging characteristic of the toner used in the present invention a charge control agent may preferably be added thereto.

In the present invention, the particle size distribution of the toner may be measured in the following manner.

Coulter counter Model TA-II (available from Coulter Electronics Inc.) is used as an instrument for measurement, to which an interface (available from Nikkaki K. K.) for providing a number-basis distribution and a volume-basis distribution, and a personal computer CX-1 (available from Canon K. K.) are connected.

For measurement, a 1%-NaCl aqueous solution as an electrolytic solution is prepared by using a reagentgrade sodium chloride. Into 100 to 150 ml of the electrolytic solution, 0.1 to 5 ml of a surfactant, preferably an alkylbenzenesulfonic acid salt, is added as a dispersant, and 0.5 to 50 mg of a sample is added thereto. The resultant dispersion of the sample in the electrolytic liquid is subjected to a dispersion treatment for about 1-3 minutes by means of an ultrasonic disperser, and then subjected to measurement of particle size distribution in the range of 2.0-50.8 microns by using the above-mentioned Coulter counter Model TA-II with a 100 micron-aperture to obtain a number-basis distribution. From the results of the number-basis distribution, the percentage (%) by number of toner particles having particle sizes of 5.0 microns or below are calculated.

Further, the glass transition point of the toner used in the present invention may be measured in the following manner.

A differential scanning calorimeter DSC 7 (available from Perkin Elmer Corp.) is used.

A sample is accurately weighed in 5-20 mg, preferably about 10 mg. The sample is placed on an aluminum pan with the use of an empty aluminum pan as the reference and is subjected to DSC differential scanning colorimetry in the temperature range of 30° C. to 200° C. at a temperature raising rate of 10° C./min in the environment of normal temperature and normal humidity. The glass transition point referred to herein is a temperature at which a main absorption peak is observed in the temperature range of 40°-100° C.

The present invention will be explained more specifically with reference to Examples.

EXAMPLE 1

A 5% solution of a soluble nylon (a quaternary nylon copolymer comprising 6 - 66 - 610 - 12 nylon units, Amilan CM-8000, mfd. by Toray K. K.) in methanol was applied on a substrate of an aluminum cylinder having a diameter of 80 mm and a length of 360 mm by dip coating and then dried thereby to form a 1 micron-thick undercoat layer.

Next, 10 parts (parts by weight, the same also in the description appearing hereinafter) of a disazo pigment represented by the following structural formula, and 5 parts of a polyvinyl butyral resin (butyral degree: 68%, number-average molecular weight: 20,000, S-LEC, mfd. by Sekisui Kayaku K. K.) were dispersed in 50 parts of cyclohexanone by means of a sand mill using 1 mm-diameter glass beads, for 20 hours.

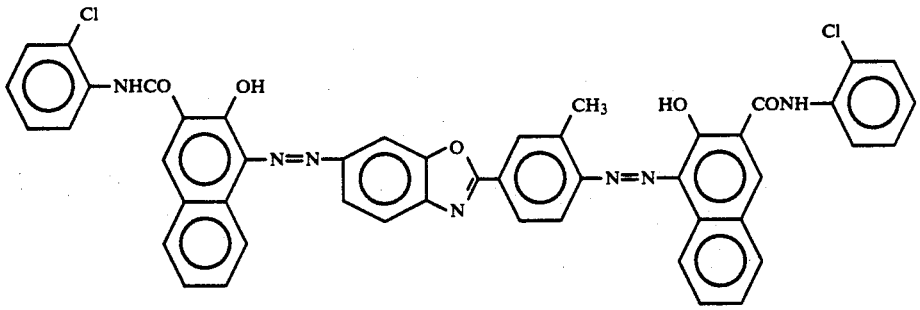

To the resultant dispersion, an appropriate amount (70-100 parts) of methyl ethyl ketone was added, and then the dispersion was applied on the undercoat layer thereby to form a 0.1 micron-thick charge generation layer.

Separately, 10 parts of a hydrazone compound represented by the following structural formula and 10 parts of a bisphenole Z-type polycarbonate resin (viscosity-average molecular weight: 30,000, Iupilon Z, mfd. by Mitsubishi Gas Kagaku K. K.), as a binder were dissolved in 65 parts of monochlorobenzene.

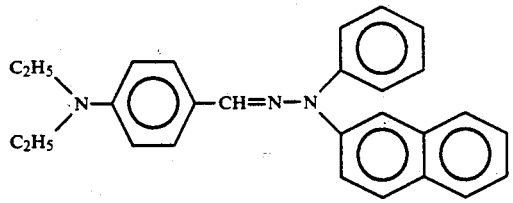

The resultant solution was applied onto the above-mentioned charge generation layer, to form a 18 microns-thick charge transport layer, whereby a photosensitive member having an abrasion characteristic of 3.0 and an average surface roughness of 0.0 micron was obtained.

The surface of the thus prepared photosensitive member was rubbed with a lapping tape (C-2000, mfd. by Fuji Photo Film K. K.) so that the resultant average surface roughness was 0.4 microns, and that in the direction of the movement of the photosensitive member was 0.4 microns.

Separately, a developer was prepared in the following manner.

100 parts of a polyester resin of bisphenol-type having a glass transition point of 58° C., 2 parts of a charge control agent (dibutyltin borate), 3 parts of a release agent (low-molecular weight polylpropylene), and 4 parts of a colorant of C.I. Solvent Red 52 were premixed melt-kneaded by means of an extruder, and cooled. The resultant mixture was micro-pulverized by means of a jet-mill pulverizer and then classified thereby to obtain a non-magnetic magenta toner having an average particles size of 12.0 microns. The thus prepared toner contained 7.0% by number of toner particles having a particles size of 5.0 microns or smaller.

6 parts of the above-mentioned non-magnetic toner was mixed with 100 parts of magnetic ferrite powder (carrier) having an average particle size of 80 microns coated with 1 wt. % of a resin comprising a vinylidene fluoride-tetrafluoroethylene copolymer and a styrene-methyl methacrylate copolymer, thereby to prepare a two-component developer.

The above-mentioned photosensitive member was assembled in an electrophotographic apparatus (a modification of a copying machine NP-3525, mfd. by Canon K. K.) for effecting an electrophotographic process which comprised a charging step, an image exposure step, a developing step, a transfer step and a cleaning step using a polyurethane rubber blade, and had a process speed of 85 mm/sec. By using such electrophotographic apparatus and the above-mentioned developer, a repetitive image formation test for evaluation was conducted. The line pressure applied from the cleaning blade to the photosensitive member was 20.0 g/cm.

The results are shown in Table 1-1 appearing hereinbelow.

EXAMPLES 2–4

Three photosensitive members were prepared in the same manner as in Example 1 except that the photosensitive member surfaces were caused to have average surface roughnesses of 2.0 microns, 3.5 microns and 5.0 microns respectively. The thus prepared three photosensitive members were respectively subjected to repetitive image formation tests in the same manner as in Example 1.

The results are shown in Table 1-1 appearing hereinbelow.

COMPARATIVE EXAMPLES 1 AND 2

A photosensitive member was prepared in the same manner as in Example 1 except that the photosensitive member surface was not subjected to rubbing by a lapping tape. The thus prepared photosensitive member was subjected to a repetitive image formation test in the same manner as in Example 1.

The results are shown in Table 1-2 appearing hereinbelow, as Comparative Example 1.

Separately, polyvinylidene fluoride powder having a particle size of 1.0 micron or below was applied onto the photosensitive member obtained in this instance by sprinkling so that the photosensitive member surface was caused to have a lubricity. The thus prepared photosensitive member was subjected to a repetitive image formation test in the same manner as in Example 1.

The results are shown in Table 1-2 appearing hereinbelow, as Comparative Example 2.

COMPARATIVE EXAMPLES 3 AND 4

Two photosensitive members were prepared in the same manner as in Example 1 except that the photosensitive member surfaces were rubbed with a lapping tape (C-2000, mfd. by Fuji Photo Film K.K.) so that the resultant average surface roughnesses were 0.2 microns and 6.0 microns, respectively, and those in the direction of the movement of the photosensitive member were 0.4 microns.

The thus prepared two photosensitive members were respectively subjected to repetitive image formation tests in the same manner as in Example 1.

The results are shown in Table 1-2 appearing hereinbelow, as Comparative Examples 3 and 4.

TABLE 1-1

| | | Example | | | |
|---|---|---|---|---|---|
| | | 1 | 2 | 3 | 4 |
| Photosensitive member | Average surface roughness (μm) | 0.4 | 2.0 | 3.5 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles*2 of 5.0 μm or smaller | 7.0 | 7.0 | 7.0 | 7.0 |
| | Glass transition temp. (°C.) | 58 | 58 | 58 | 58 |
| Blade | Line pressure*3 of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 1-2

| | | Comparative Example | | | |
|---|---|---|---|---|---|
| | | 1 | 2 | 3 | 4 |
| Photosensitive member | Average surface roughness (μm) | 0.0 | 0.0 | 0.2 | 6.0 |
| | Average surface roughness (μm)*1 | 0.0 | 0.0 | 0.4 | 0.4 |
| | Abrasion characteristic | 3.0 | 3.0 | 3.0 | 3.0 |
| | Roughening method | — | — | Mechanical abrasion | |
| Toner | Kind | Non-magnetic | | | |
| | Proportion of particles*2 of 5.0 μm or smaller | 7.0 | 7.0 | 7.0 | 7.0 |
| | Glass transition temp. (°C.) | 58 | 58 | 58 | 58 |
| Blade | Line pressure*3 of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | I.S. Δ | ○ | I.D Δ |
| | 200 sheets | R.B. x | I.S. Δ | ○ | I.D. Δ |
| | 1000 sheets | — | R.B. x | R.B. x | I.D. x |
| | 5000 sheets | — | — | — | — |
| | 10000 sheets | — | — | — | — |
| | 50000 sheets | — | — | — | — |

*1: Average surface roughness with respect to the direction of the movement of the photosensitive member.
*2: Proportion of particles having a particle size of 0.5 microns or smaller (% by number) in the particle size distribution.
*3: Line pressure of the blade to the photosensitive member surface.

Incidentally, in the above Table 1 (Table 1-1 and 1-2) and the Tables 2–9 appearing hereinafter, the symbols have the following meaning:

(1) I.S. (image staining): A state wherein staining was observed on the white background of the resultant image.

(2) I.D. (image defect): A state wherein streaks appeared in the resultant image.

(3) C.F. (cleaning failure): A state wherein staining and unevenness appeared in the whole image due to the toner which remained on the photosensitive member surface and passed through the clearance between the cleaning blade and the photosensitive member.

(4) R.B. (reverse of blade): A state wherein the reverse of the cleaning blade and/or the breakage of the edge portion thereof occurred.

Further, the symbols "○", "Δ", and "x" have the following meanings:

○ ... No defect was observed in the resultant image.

Δ ... A certain problem was slightly observed in the resultant image, but was negligible in practice.

x ... A certain problem was remarkably observed in the resultant image.

As shown in the above Examples 1–4 and Comparative Examples 1–4, in the electrophotographic photosensitive member to be used in an electrophotographic apparatus which has a blade cleaning system using a rubber blade and a developing means using a non-magnetic toner with a glass transition point of 60° C. or below and which provides a process speed of 80 mm/sec or larger, the reverse of the cleaning blade and the breakage of the edge portion thereof can be prevented by causing the photosensitive member to have an average surface roughness of 0.3 microns to 5.0 microns.

EXAMPLES 5–8

Non-magnetic toners respectively having glass transition points of 52° C. and 55° C. were prepared in the same manner as in Example 1 except that polyester resins having glass transition points of 52° C. and 55° C. were respectively used instead of that used in Example 1. The thus obtained toner contained 6.6% by number of particles having a particle size of 5.0 microns or less.

Separately, two photosensitive members were prepared in the same manner as in Example 1 except that the photosensitive member surfaces were rubbed with a lapping tape (C-2000, mfd. by Fuji Photo Film K. K.) so that the resultant average surface roughnesses were 0.4 microns and 5.0 microns, respectively, and those in the direction of the movement of the photosensitive member were 0.4 microns.

Then, there were provided four combinations of the toner and the photosensitive member so that the combinations of the glass transition point of the toner binder resin and the average surface roughness of the photosensitive member were respectively 52° C. and 0.4 microns (Example 5), 52° C. and 5.0 microns (Example 6), 55° C. and 0.4 microns (Example 7), and 55° C. and 5.0 microns (Example 8). These four combinations were respectively assembled in the electrophotographic apparatus used in Example 1 and subjected to a repetitive image formation test in the same manner as in Example 1.

The results are shown in Table 2-1 appearing hereinbelow, as Examples 5–8.

COMPARATIVE EXAMPLES 5 AND 6

A photosensitive member was prepared in the same manner as in Example 5 or 6, except that the photosensitive member surface was not subjected to rubbing by a lapping tape. The thus prepared photosensitive member was subjected to repetitive image formation test in the same manner as in Example 5. The results are shown in Table 2-2 appearing hereinbelow, as Comparative Example 5.

Further, a photosensitive member was prepared in the same manner as in Example 7 or 8 except that the photosensitive member surface was not subjected to rubbing by a lapping tape. The thus prepared photosensitive member was subjected to repetitive image formation test in the same manner as in Example 7.

The results are shown in Table 2-2 appearing hereinbelow as Comparative Example 6.

TABLE 2-1

| | | Example | | | |
|---|---|---|---|---|---|
| | | 5 | 6 | 7 | 8 |
| Photosensitive member | Average surface roughness (μm) | 0.4 | 5.0 | 0.4 | 5.0 |
| | Average surface roughness (μm) | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 6.6 | 6.6 | 6.6 | 6.6 |
| | Glass transition temp. (°C.) | 52 | 52 | 55 | 55 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 2-2

| | | Comparative Example | |
|---|---|---|---|
| | | 5 | 6 |
| Photosensitive member | Average surface roughness (μm) | 0.0 | 0.0 |
| | Average surface roughness (μm)*1 | 0.0 | 0.0 |
| | Abrasion characteristic | 3.0 | 3.0 |
| | Roughening method | Mechanical abrasion | |
| Toner | Kind | Non-magnetic | |
| | Proportion of particles*2 of 5.0 μm or smaller | 6.6 | 6.6 |
| | Glass transition temp. (°C.) | 52 | 55 |
| Blade | Line pressure*3 of blade (g/cm) | 20.0 | 20.0 |
| Apparatus | Process speed (mm/sec) | 85 | 85 |
| Repetitive copying evaluation | initial | R.B. x | R.B. x |
| | 200 sheets | — | — |
| | 1000 sheets | — | — |
| | 5000 sheets | — | — |
| | 10000 sheets | — | — |
| | 50000 sheets | — | — |

As shown in the above Examples 1–8 and Comparative Examples 1 - 6, in the electrophotographic photosensitive member to be used in an elecrrophotographic apparatus which as a blade cleaning system using a rubber blade and a developing means using a dry non-magnetic toner, and which provides a process speed of 80 mm/sec or larger, the reverse of the cleaning blade and the breakage of the edge portion thereof can occur when a toner with a glass transition point of 60° C. or below is simply used.

However, the problems can be prevented by causing the photosensitive member to have an average surface roughness of 0.3 microns to 5.0 microns.

EXAMPLES 9-12

Two photosensitive members were prepared in the same manner as in Example 1 except that the photosensitive member surfaces were rubbed with a lapping tape (C-2000, mfd. by Fuji Photo Film K.K.) so that the resultant average surface roughnesses were 0.4 microns and 5.0 microns, respectively, and those in the direction of the movement of the photosensitive member were 0.4 microns.

The thus prepared photosensitive members were respectively assembled in the same electrophotographic apparatus used in Example 1 and subjected to repetitive image formation tests in the same manner as in Example 1 except that the process speed was 140 mm/sec.

The results are shown in Table 3-1 appearing hereinbelow, as Examples 9 and 10.

Further, the two species of photosensitive members prepared above were subjected to the same repetitive image formation test as described above except that the process speed was 200 mm/sec.

The results are shown in Table 3-1 appearing hereinbelow as Examples 11 and 12.

COMPARATIVE EXAMPLES 7 AND 8

A photosensitive member was prepared in the same manner as in Example 9 or 10 except that the photosensitive member surface was not subjected to rubbing by a lapping tape. The thus prepared photosensitive member was subjected to repetitive image formation tests in the same manner as in Example 9.

The results are shown in Table 3-2 appearing hereinbelow, as Comparative Example 7.

Further, a photosensitive member was prepared in the same manner as in Example 11 or 12, except that the photosensitive member surface was not subjected to rubbing by a lapping tape. The thus prepared photosensitive member was subjected to the same repetitive image formation test as in Example 11.

The results are shown in Table 3-2 appearing hereinbelow, as Comparative Example 8

TABLE 3-1

| | | Example | | | |
|---|---|---|---|---|---|
| | | 9 | 10 | 11 | 12 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 140 | 140 | 200 | 200 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 3-2

| | | Comparative Example | |
|---|---|---|---|
| | | 7 | 8 |
| Photosensitive member | Average surface roughness (μm) | 0.0 | 0.0 |
| | Average surface roughness (μm)*1 | 0.0 | 0.0 |
| | Abrasion characteristic | 3.0 | 3.0 |
| | Roughening method | — | — |
| Toner | Kind | Non-magnetic | |
| | Proportion of particles of 5.0 μm or smaller | 7.0 | 7.0 |
| | Glass transition temp. (°C.) | 58 | 58 |
| Blade | Line pressure of blade (g/cm) | 20.0 | 20.0 |
| Apparatus | Process speed (mm/sec) | 140 | 200 |
| Repetitive copying evaluation | initial | R.B. x | R.B. x |
| | 200 sheets | — | — |
| | 1000 sheets | — | — |
| | 5000 sheets | — | — |
| | 10000 sheets | — | — |
| | 50000 sheets | — | — |

As shown in the above Examples 1-4 and9-12, and Comparative Examples 1-4 and 7-8, in the electrophotographic photosensitive member to be used in an electrophotographic apparatus which has a blade cleaning system using a rubber blade and a developing means using a dry non-magnetic toner with a glass transition point of 60° C. or below, the reverse of the cleaning blade and the breakage of the edge portion thereof can occur when the process speed is 80 mm/sec or larger. However, these problems can be prevented by causing the photosensitive member to have an average surface roughness of 0.3 micron to 5.0 microns.

Hereinbelow, there are specifically described methods by which reverse of a cleaning blade and breakage of the edge portion thereof can more effectively be prevented in combination with roughening of a photosensitive member surface.

EXAMPLES 13-16

A photosensitive member was prepared in the same manner as in Example 1 except that a bisphenol Z-type polycarbonate resin having a viscosity-average molecular weight of 10,000 was used instead of that having a viscosity-average molecular weight of 30,000 used in Example 1.

The above prepared photosensitive member had an abrasion characteristic of 15.0 and an average surface roughness of 0.0 micron.

The surface of the thus prepared photosensitive member was rubbed with a lapping tape (C-2000, mfd, by Fuji Photo Film K. K.) so that the resultant average surface roughnesses were 0.4 micron, and 5.0 microns, respectively, and those in the direction of the movement of the photosensitive member were 0.4 micron.

These photosensitive members were assembled in the same electrophotographic apparatus as in Example 1 and subjected to a repetitive image formation test in the same manner as in Example 1.

The results are shown in Table 4-1 appearing hereinbelow, as Examples 13 and 14.

Further, a photosensitive member was prepared in the same manner as in Example 1 except that a bisphenol Z-type polycarbonate resin having a viscosity-average molecular weight of 20,000 was used instead of that having a viscosity-average molecular weight of 30,000 used in Example 1.

The above prepared photosensitive member had an abrasion characteristic of 8.0 and an average surface roughness of 0.0 micron.

The surface of the thus prepared photosensitive member was rubbed with a lapping tape (C-2000, mfd, by fuji Photo film K. K.) so that the resultant average surface roughnesses were 0.4 micron, and 5.0 micron, respectively, and those in the direction of the movement of the photosensitive member were 0.4 micron.

These photosensitive members were assembled in the same electrophotographic apparatus as in Example 1 and subjected to a repetitive image formation test in the same manner as in Example 1.

The results are shown in Table 4-1 appearing hereinbelow, as Examples 15 and 16.

EXAMPLES 17-20

A photosensitive member was prepared in the same manner as in Example 1 except that the charge transport layer was formed in the following manner.

10 parts of a bisphenol Z-type polycarbonate resin (viscosity-average molecular weight: 30,000), 5 parts of polytetrafluoroethylene resin powder (trade name; Lubron L-2, mfd. by Daikin Kogyo K. K.) as fluorine-containing resin powder were dispersed in 40 parts of monochlorobenzene and 15 parts of tetrahydrofuran by means of a stainless ball mill for 50 hours. To the resultant dispersion, 10 parts of a hydrazone compound represented by the following structural formula were dissolved to prepare a coating liquid. The coating liquid was applied onto the charge generation layer by dip coating to form a 18 micron-thick charge transport layer, whereby a photosensitive member having an abrasion characteristic of 1.0 and an average surface roughness of 0.0 micron was obtained.

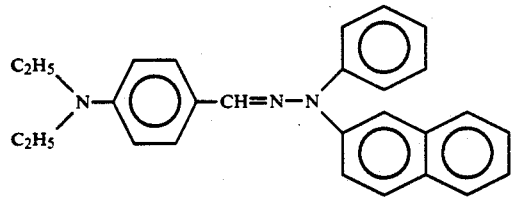

Separately, a photosensitive member having an abrasion characteristic of 0.3 and an average surface roughness of 0.0 micron was prepared in the same manner as described above except that 10 parts of the polytetrafluoroethylene resin powder were used.

The surfaces of the thus prepared photosensitive member were rubbed with a lapping tape (C-2000, mfd, by Fuji Photo Film K. K.) so that the resultant average surface roughnesses were 0.4 micron and 5.0 micron, and those in the direction of the movement of the photosensitive member were 0.4 micron.

In the above-mentioned manner, there were provided four photosensitive members, so that the combinations of the abrasion characteristic and the average surface roughness of the photosensitive member were respectively 1.0 and 0.4 micron (Example 17), 1.0 and 5.0 micron (Example 18), 0.3 and 0.4 micron (Example 19), and 0.3 and 5.0 microns (Example 20). These four species of photosensitive members were respectively assembled in the electrophotographic apparatus used in Example 1 and subjected to a repetitive image formation test in the same manner as in Example 1.

The results are shown in Table 4-2 appearing hereinbelow, as Examples 17-20.

COMPARATIVE EXAMPLES 9-12

A photosensitive member was prepared in the same manner as in Example 13 or 14 except that the photosensitive member surface was not subjected to rubbing by a lapping tape. The thus prepared photosensitive member was subjected to a repetitive image formation test in the same manner as in Example 13.

The results are shown in Table 4-3 appearing hereinbelow, as Comparative Example 9.

Further, a photosensitive member was prepared in the same manner as in Example 15 or 16 except that the photosensitive member surface was not subjected to rubbing by a lapping tape. The thus prepared photosensitive member was subjected to a repetitive image formation test in the same manner as in Example 15.

The results are shown in Table 4-3 appearing hereinbelow, as Comparative Example 10.

Further, a photosensitive member was prepared in the same manner as in Example 17 or 18 except that the photosensitive member surface was not subjected to rubbing by a lapping tape. The thus prepared photosensitive member was subjected to a repetitive image formation test in the same manner as in Example 17.

The results are shown in Table 4-3 appearing hereinbelow as Comparative Example 11.

Further, a photosensitive member was prepared in the same manner as in Example 19 or 20 except that the photosensitive member surface was not subjected to rubbing by a lapping tape. The thus prepared photosensitive member was subjected to a repetitive image formation test in the same manner as in Example 19.

The results are shown in Table 4-3 appearing hereinbelow, as Comparative Example 12.

TABLE 4-1

| | | Example | | | |
|---|---|---|---|---|---|
| | | 13 | 12 | 13 | 14 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 15.0 | 15.0 | 8.0 | 8.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 4-2

| | | Example | | | |
|---|---|---|---|---|---|
| | | 17 | 18 | 19 | 20 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 1.0 | 1.0 | 0.3 | 0.3 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | R.B. Δ | R.B. Δ | R.B. Δ | R.B. Δ |

TABLE 4-3

| | | Comparative Example | | | |
|---|---|---|---|---|---|
| | | 9 | 10 | 11 | 12 |
| Photosensitive member | Average surface roughness (μm) | 0.0 | 0.0 | 0.0 | 0.0 |
| | Average surface roughness (μm)*1 | 0.0 | 0.0 | 0.0 | 0.0 |
| | Abrasion characteristic | 15.0 | 8.0 | 1.0 | 0.3 |
| | Roughening method | — | — | — | — |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | R.B. x | R.B. x |
| | 200 sheets | R.B. Δ | R.B. x | — | — |
| | 1000 sheets | R.B. x | — | — | — |
| | 5000 sheets | — | — | — | — |
| | 10000 sheets | — | — | — | — |
| | 50000 sheets | — | — | — | — |

As shown in the above Examples 1-4 and 13-20, and Comparative Examples 1-4 and 9-12, in the electrophotographic photosensitive member to be used in an electrophotographic apparatus which has a blade cleaning system using a rubber blade and a developing means using a dry non-magnetic toner with a glass transition point of 60° C. or below, and which provides a process speed of 80 mm/sec or larger, the reverse of the cleaning blade and the breakage of the edge portion thereof can occur more easily when the abrasion characteristic of the photosensitive member was lower than 2.0 according to a Taber's abrasion tester, as compared with in the case of an abrasion characteristic of 2.0 or more. However, these problems can be prevented by causing the photosensitive member to have an average surface roughness of 0.3 micron to 5.0 microns. In such case, the photosensitive member may more preferably have an abrasion characteristic of 2.0 or larger.

EXAMPLES 21-28

Four species of toners were prepared in the same manner as in Example 1 except that the classifications were effected so that the resultant toners respectively contained 3.2% by number, 4.6% by number, 9.7% by number and 14.3% by number of particles having a particle size of 5.0 microns or below.

Separately, two photosensitive members were prepared in the same manner as in Example 1 except that the photosensitive member surfaces were rubbed with a lapping tape (C-2000, mfd. by Fuji Photo Film K. K.) so that the resultant average surface roughnesses were 0.4 micron and 5.0 microns, respectively, and those in the direction of the movement of the photosensitive member were 0.4 micron.

Then, there were provided eight combinations of the toner and the photosensitive member so that the combinations of the proportion of particles with a particle size of 5.0 microns or below in the toner and the average surface roughness of the photosensitive member were respectively 3.2% by number and 0.4 micron (Example 21), 3.2% by number and 5.0 microns (Example 22), 4.6% by number and 0.4 micron (Example 23), 4.6% by number and 5.0 microns (Example 24), 9.7% by number and 0.4 micron (Example 25), 9.7% by number and 5.0 microns (Example 26), 14.3% by number and 0.4 micron (Example 27), and 14.3% by number and 5.0 microns (Example 28). These eight combinations were respectively assembled in the electrophotographic apparatus used in Example 1 and subjected to a repetitive image formation test in the same manner as Example 1.

The results are shown in Tables 5-1 and 5-2 appearing hereinbelow, as Examples 21-28.

COMPARATIVE EXAMPLES 13-16

A photosensitive member was prepared in the same manner as in Example 21 or 22, except that the photosensitive member surface was not subjected to rubbing by a lapping tape. The thus prepared photosensitive member was subjected to a repetitive image formation tests in the same manner as in Example 21.

The results are shown in Table 5-3 appearing hereinbelow, as Comparative Example 13.

Further, a photosensitive member was prepared in the same manner as in Example 23 or 24 except that the photosensitive member surface was not subjected to rubbing by a lapping tape. The thus prepared photosensitive member was subjected to repetitive image formation test in the same manner as in Example 23.

The results are shown in Table 5-3 appearing hereinbelow as Comparative Example 14.

Further a photosensitive member was prepared in the same manner as in Example 25 or 26, except that the photosensitive member surface was not subjected to rubbing by a lapping tape. The thus prepared photosensitive member was subjected to a repetitive image formation test in the same manner as in Example 25.

The results are shown in Table 5-3 appearing hereinbelow, as Comparative Example 15.

Further, a photosensitive member was prepared in the same manner as in Example 27 or 28 except that the photosensitive member surface was not subjected to rubbing by a lapping tape. The thus prepared photosensitive member was subjected to repetitive image formation test in the same manner as in Example 27.

The results are shown in Table 5-3 appearing hereinbelow as Comparative Example 16.

TABLE 5-1

| | | Example | | | |
|---|---|---|---|---|---|
| | | 21 | 22 | 23 | 24 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 3.2 | 3.2 | 4.6 | 4.6 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | R.B. Δ | R.B. Δ | R.B. Δ | R.B. Δ |

TABLE 5-2

| | | Example | | | |
|---|---|---|---|---|---|
| | | 25 | 26 | 27 | 28 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 9.7 | 9.7 | 14.3 | 14.3 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 5-3

| | | Comparative Example | | | |
|---|---|---|---|---|---|
| | | 13 | 14 | 15 | 16 |
| Photosensitive member | Average surface roughness (μm) | 0.0 | 0.0 | 0.2 | 0.0 |
| | Average surface roughness (μm)*1 | 0.0 | 0.0 | 0.4 | 0.4 |
| | Abrasion characteristic | 3.0 | 3.0 | 3.0 | 3.0 |
| | Roughening method | — | — | — | — |

TABLE 5-3-continued

| | | Comparative Example | | | |
|---|---|---|---|---|---|
| | | 13 | 14 | 15 | 16 |
| Toner | Kind | Non-magnetic | | | |
| | Proportion of particles of 5.0 μm or smaller | 3.2 | 4.6 | 9.7 | 14.3 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | R.B. x | R.B. x | ○ | ○ |
| | 200 sheets | — | — | R.B. x | R.B. Δ |
| | 1000 sheets | — | — | — | R.B. x |
| | 5000 sheets | — | — | — | — |
| | 10000 sheets | — | — | — | — |
| | 50000 sheets | — | — | — | — |

As shown in the above Examples 1–4 and 21 28, and Comparative Examples 1–4 and 13–16, in the electrophotographic photosensitive member to be used in an electrophotographic apparatus which has a blade cleaning system using a rubber blade and a developing means using a dry non-magnetic toner with a glass transition point of 60° C. or below, and which provides a process speed of 80 mm/sec or larger, the reverse of the cleaning blade and the breakage of the edge portion thereof can occur more easily when the toner contains less than 5.0% by number of particles having a particle size of 5.0 microns or less, as compared with in the case of 5.0% by number or more of particles of 5.0 microns or less. These problems can be prevented by causing the photosensitive member to have an average surface roughness of 0.3 to 5.0 microns. However, it is more preferable that the toner comprises 5.0% by number or more of particles having a particle size of 5.0 microns or less.

EXAMPLES 29–39

The surface of the photosensitive member obtained in Example 1 was rubbed with a lapping tape (C-2000, mfd. by Fuji Photo Film K. K.) so that the resultant average surface roughnesses were 0.4 micron or 5.0 microns, respectively, and those in the direction of the movement of the photosensitive member were 0.4 micron.

Then, there were provided light combinations of a cleaning blade and the photosensitive member so that the combination of the line pressure of the cleaning blade applied to the photosensitive member and the average surface roughness of the photosensitive member were respectively 3.0 g/cm and 0.4 micron (Example 29), 3.0 g/cm and 5.0 micron (Example 30), 7.0 g/cm and 0.4 micron (Example 31), 7.0 g/cm and 5.0 microns (Example 32), 32.0 g/cm and 0.4 micron (Example 33), 32.0 g/cm and 5.0 microns (Example 34), 38.0 g/cm and 0.4 micron (Example 35), and 38.0 g/cm and 5.0 microns (Example 36). These eight combinations were respectively assembled in the electrophotographic apparatus used in Example 1 and subjected to a repetitive image formation test in the same manner as in Example 1.

The results are shown in Tables 6-1 and 6-2 appearing hereinbelow, as Examples 29–36.

COMPARATIVE EXAMPLES 17-20

A photosensitive member was prepared in the same manner as in Example 29 or 30, except that the photosensitive member surface was not subjected to rubbing by a lapping tape. The thus prepared photosensitive member was subjected to a repetitive image formation test in the same manner as in Example 29.

The results are shown in Table 6-3 appearing hereinbelow, as Comparative Example 17.

Further, a photosensitive member was prepared in the same manner as in Example 31 or 32 except that the photosensitive member surface was not subjected to rubbing by a lapping tape. The thus prepared photosensitive member was subjected to repetitive image formation test in the same manner as in Example 31.

The results are shown in Table 6 appearing hereinbelow as Comparative Example 18.

Further, a photosensitive member was prepared in the same manner as in Example 33 or 34, except that the photosensitive member surface was not subjected to rubbing by a lapping tape. The thus prepared photosensitive member was subjected to a repetitive image formation test in the same manner as in Example 33.

The results are shown in Table 6-3 appearing hereinbelow, as Comparative Example 19.

Further, a photosensitive member was prepared in the same manner as in Example 35 or 36 except that the photosensitive member surface was not subjected to rubbing by a lapping tape. The thus prepared photosensitive member was subjected to repetitive image formation test in the same manner as in Example 35.

The results are shown in Table 6 appearing hereinbelow as Comparative Example 20.

TABLE 6-1

| | | Example | | | |
|---|---|---|---|---|---|
| | | 29 | 30 | 31 | 32 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 3.0 | 3.0 | 7.0 | 7.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | C.F. Δ | C.F. Δ | ○ | ○ |
| | 50000 sheets | C.F. x | C.F. x | ○ | ○ |

TABLE 6-2

| | | Example | | | |
|---|---|---|---|---|---|
| | | 33 | 34 | 35 | 36 |
| Photosensitive member | Average surface roughness (μm) | 0.4 | 5.0 | 0.4 | 5.0 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 32.0 | 32.0 | 38.0 | 38.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | R.B. Δ | R.B. Δ |

TABLE 6-3

| | | Comparative Example | | | |
|---|---|---|---|---|---|
| | | 17 | 18 | 19 | 20 |
| Photosensitive member | Average surface roughness (μm) | 0.0 | 0.0 | 0.2 | 0.0 |
| | Average surface roughness (μm)*1 | 0.0 | 0.0 | 0.4 | 0.4 |
| | Abrasion characteristic | 3.0 | 3.0 | 3.0 | 3.0 |
| | Roughening method | — | — | — | — |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 3.0 | 7.0 | 32.0 | 38.0 |
| Apparatus | Process speed (mm/sec) | 85 | 85 | 85 | 85 |
| Repetitive copying evaluation | initial | ○ | ○ | R.B. x | R.B. x |
| | 200 sheets | ○ | R.B. Δ | — | — |
| | 1000 sheets | R.B. Δ | R.B. x | — | — |
| | 5000 sheets | R.B. x | — | — | — |
| | 10000 sheets | — | — | — | — |
| | 50000 sheets | — | — | — | — |

As shown in the above Examples 1-4 and 29-36, and Comparative Examples 1-4 and 17-20, in the electrophotographic photosensitive member to be used in an electrophotographic apparatus which has a blade cleaning system using a rubber blade and a developing means using a dry non-magnetic toner with a glass transition point of 60° C. or below, and which provides a process speed of 80 mm/sec or larger, cleaning failure due to the passing-through of the residual toner can easily occur when the line pressure of the cleaning blade applied to the photosensitive member surface is smaller than 5.0 g/cm. Further, the reverse of the cleaning blade and the breakage of the edge portion thereof can occur more easily when the line pressure of the cleaning blade applied to the photosensitive member surface exceeds 30.0 g/cm. These problems of the reverse of the blade and the breakage of the edge portion thereof can be prevented by causing the photosensitive member to have an average surface roughness of 0.3 micron to 5.0 microns. In order to effect suitable cleaning, it is further preferred that the line pressure of the cleaning blade to the photosensitive member surface is 5.0 g/cm to 30.0 g/cm.

EXAMPLES 37–44

Eight species of photosensitive members were prepared in the same manner as in Example 1 except that they were prepared so as to provide the following combinations of the average surface roughness of the photosensitive member, and the average surface roughness in the direction of the movement thereof.

| | Average surface roughness | Average surface roughness in movement direction |
|---|---|---|
| Example 37 | 0.4 micron | 0.1 micron |
| 38 | 5.0 | 0.1 |
| 39 | 0.4 | 0.3 |
| 40 | 5.0 | 0.3 |
| 41 | 0.4 | 0.6 |
| 42 | 5.0 | 0.6 |
| 43 | 0.4 | 1.0 |
| 44 | 5.0 | 1.0 |

These eight photosensitive members were respectively assembled in the same electrophotographic apparatus as in Example 1 and subjected to a repetitive image formation test in the same manner as in Example 1.

The results are shown in the following Tables 7-1 and 7-2 as Examples 37–44.

TABLE 7-1

| | | Example | | | |
|---|---|---|---|---|---|
| | | 37 | 38 | 39 | 40 |
| Photosensitive member | Average surface roughness (μm) | 0.4 | 5.0 | 0.4 | 5.0 |
| | Average surface roughness (μm)*1 | 0.1 | 0.1 | 0.3 | 0.3 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | ○ | ○ | ○ | ○ |

TABLE 7-2

| | | Example | | | |
|---|---|---|---|---|---|
| | | 41 | 42 | 43 | 44 |
| Photosensitive member | Average surface roughness (μm) | 0.4 | 5.0 | 0.4 | 5.0 |

TABLE 7-2-continued

| | | Example | | | |
|---|---|---|---|---|---|
| | | 41 | 42 | 43 | 44 |
| | Average surface roughness (μm)*1 | 0.6 | 0.6 | 1.0 | 1.0 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | 7.0 | 7.0 | 7.0 | 7.0 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | |
| | 50000 sheets | R.B. Δ | R.B. Δ | R.B. Δ | R.B. Δ |

As shown in the above Examples 1–4 and 37–44, and Comparative Examples 1–4, in the electrophotographic photosensitive member to be used in an electrophotographic apparatus which has a blade cleaning system using a rubber blade and a developing means using a dry non-magnetic toner with a glass transition point of 60° C. or below, and which provides a process speed of 80 mm/sec or larger, the photosensitive member is liable to be flattened when the average surface roughness in the direction of the movement thereof exceeds 0.5 micron. As a result, the reverse of the cleaning blade and the breakage of the edge portion thereof can occur in repetitive use. These problems can be prevented by causing the photosensitive member to have an average surface roughness of 0.3 to 5.0 microns. Further, it is preferred that the average surface roughness in the direction of the movement of the photosensitive member is 0.5 micron or less.

EXAMPLES 45–47

A photosensitive member was prepared in the same manner as in Example 1 except that the charge transport layer was formed in the following manner.

10 parts of a hydrazine compound represented by the following structural formula, 10 parts of a bisphenol Z-type polycarbonate resin (viscosity-average molecular weight; 30,000, and 1 part of silicone powder having a particle size of 2.0 micron (Tospearl 120, mfd. by Toshiba Silicone K. K.) were dissolved or dispersed in 65 parts of monochlorobenzene.

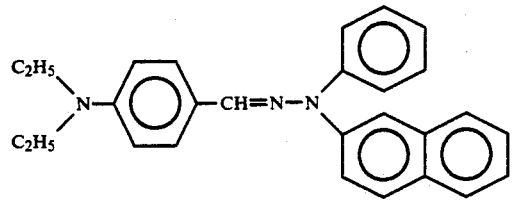

The resultant mixture was applied onto the charge generation layer, to form a 18 micron-thick charge transport layer, whereby a photosensitive member having an abrasion characteristic of 3.0 and an average surface roughness of 0.4 micron was obtained.

Further, two species of photosensitive members were prepared in the same manner as described above except that 3 parts and 10 parts of the silicone powder were respectively used. The thus prepared photosensitive members had an abrasion characteristic of 3.0, and respectively had average surface roughnesses of 2.0 microns and 5.0 microns.

These three species of photosensitive members were subjected to a repetitive image formation test in the same manner as in Example 1.

The results are shown in Table 8-1 appearing hereinafter as Examples 45–47.

COMPARATIVE EXAMPLES 21–23

Three photosensitive members were prepared in the same manner as in Example 45, 46 or 47 except that 0.2 part, 0.5 part and 15 parts of the silicone powder (Tospearl 120, mfd. by Toshiba Silicone K. K.) were respectively used. The thus prepared three photosensitive members had an abrasiveness of 3.0, and had average surface roughnesses of 0.1 micron, 0.2 micron and 6.0 microns respectively. The thus prepared three photosensitive members were respectively subjected to repetitive image formation tests in the same manner as in Examples 45–47.

The results are shown in Table 8-2 appearing hereinbelow, as Comparative Examples 21–23.

TABLE 8-1

| | | Example | | |
|---|---|---|---|---|
| | | 45 | 46 | 47 |
| Photosensitive member | Average surface roughness (μm) | 0.4 | 2.0 | 5.0 |
| | Average surface roughness (μm)*1 | 0.4 | 2.0 | 5.0 |
| | Abrasion characteristic | 3.0 | 3.0 | 3.0 |
| | Roughening method | coating | coating | coating |
| Toner | Kind | Non-magnetic | | |
| | Proportion of particles of 5.0 μm or smaller | 7.0 | 7.0 | 7.0 |
| | Glass transition temp. (°C.) | 58 | 58 | 58 |
| Blade | Line pressure of blade (g/cm) | 20.0 | 20.0 | 20.0 |
| Apparatus | Process speed (mm/sec) | 85 | 85 | 85 |
| Repetitive copying evaluation | initial | ○ | ○ | ○ |
| | 200 sheets | ○ | ○ | ○ |
| | 1000 sheets | ○ | ○ | ○ |
| | 5000 sheets | ○ | ○ | ○ |
| | 10000 sheets | R.B. Δ | R.B. x | ○ |
| | 50000 sheets | R.B. x | R.B. x | R.B. Δ |

TABLE 8-2

| | | Comparative Example | | |
|---|---|---|---|---|
| | | 21 | 22 | 23 |
| Photosensitive member | Average surface roughness (μm) | 0.1 | 0.2 | 6.0 |
| | Average surface roughness (μm)*1 | 0.1 | 0.2 | 6.0 |
| | Abrasion characteristic | 3.0 | 3.0 | 3.0 |
| | Roughening method | coating | coating | coating |
| Toner | Kind | Non-magnetic | | |
| | Proportion of particles of 5.0 μm or smaller | 7.0 | 7.0 | 7.0 |
| | Glass transition temp. (°C.) | 58 | 58 | 58 |
| Blade | Line pressure of blade (g/cm) | 20.0 | 20.0 | 20.0 |
| Apparatus | Process speed (mm/sec) | 85 | 85 | 85 |
| Repetitive copying evaluation | initial | R.B. x | R.B. x | ○ |
| | 200 sheets | — | — | I.D. Δ |
| | 1000 sheets | — | — | I.D. x |
| | 5000 sheets | — | — | — |
| | 10000 sheets | — | — | — |
| | 50000 sheets | — | — | — |

As shown in the above Examples 1–4 and 45–47, and Comparative Examples 1–4 and 21–23, in the electrophotographic photosensitive member to be used in an electrophotographic apparatus which has a blade cleaning system using a rubber blade and a developing means using a dry non-magnetic toner with a glass transition point of 60° C. or below, and which provides a process speed of 80 mm/sec or larger, the reverse of the cleaning blade and the breakage of the edge portion thereof can be prevented by causing the photosensitive member to have an average surface roughness of 0.3 to 5.0 microns.

In such case, when the photosensitive member surface is roughened by mechanical abrasion, the lubricity between the cleaning blade and the photosensitive member surface is further enhanced by the shavings produced by the mechanical abrasion. Therefore, the photosensitive member surface may preferably be roughened by mechanical abrasion.

EXAMPLES 48–51

Yellow and cyan toners were prepared in the same manner as in Example 1 except that 5 parts of C.I. Pigment Yellow 17 and 6 parts of a phthalocyanine pigment were respectively used as a colorant.

Separately, there was provided a electrophotographic apparatus (a modification of a copying machine NP-3525, mfd. by Canon K. K.) which included three developing apparatus corresponding to yellow, cyan and magenta being movably disposed, and was capable of providing a full-color image by effecting an electrophotographic cycle three times which comprised charging step, image exposure step, developing step, transfer step using a transfer drum, and a cleaning step using a rubber blade.

By using the above-mentioned yellow and cyan toners and the magenta toner used in Example 1, repetitive full-color image formation was conducted by means of the above electrophotographic apparatus. The results are shown in the following Table 9, as Examples 48–51.

Further, a photosensitive member was prepared in the same manner as in Example 1 except that the photosensitive member surface was not subjected to rubbing by a lapping tape. The thus prepared photosensitive member was subjected to a repetitive full-color image formation test in the same manner as described above.

The results are shown in Table 9 appearing hereinbelow, as Comparative Examples 24 and 25.

Incidentally, the particle size distribution and glass transition point of the toner used in the above-mentioned Examples and Comparative Examples were those as shown in Table 9.

TABLE 9-1

| | | Example | | | |
|---|---|---|---|---|---|
| | | 48 | 49 | 50 | 51 |
| Photosensitive member | Average surface roughness (μm) | 0.5 | 4.8 | 0.5 | 4.8 |
| | Average surface roughness (μm)*1 | 0.4 | 0.4 | 0.4 | 0.4 |
| | Abrasion characteristic | 3.0 | 3.0 | 3.0 | 3.0 |
| | Roughening method | Mechanical abrasion | | | |
| Toner | Kind | Non-magnetic | | | |
| | Proportion of particles of 5.0 μm or smaller | Y C M<br>3.5 3.6 3.3 | Y C M<br>3.5 3.6 3.3 | Y C M<br>6.2 6.5 6.4 | Y C M<br>6.2 6.5 6.4 |
| | Glass transition temp. (°C.) | 58 | 58 | 58 | 58 |
| Blade | Line pressure of blade (g/cm) | 20.0 | 20.0 | 20.0 | 20.0 |
| Apparatus | Process speed (mm/sec) | 85 | 85 | 85 | 85 |
| Repetitive copying evaluation | initial | ○ | ○ | ○ | ○ |
| | 200 sheets | ○ | ○ | ○ | ○ |
| | 1000 sheets | ○ | ○ | ○ | ○ |
| | 5000 sheets | ○ | ○ | ○ | ○ |
| | 10000 sheets | ○ | ○ | ○ | ○ |
| | 50000 sheets | R.B.<br>Δ | R.B.<br>Δ | ○ | ○ |

Y: yellow, C: cyan, M: magenta

TABLE 9-2

| | | Comparative Example | |
|---|---|---|---|
| | | 24 | 25 |
| Photosensitive member | Average surface roughness (μm) | 0.0 | 0.0 |
| | Average surface roughness (μm)*1 | 0.0 | 0.0 |
| | Abrasion characteristic | 3.0 | 3.0 |
| | Roughening method | — | — |
| Toner | Kind | Non-magnetic | |
| | Proportion of particles of 5.0 μm or smaller | Y C M<br>3.5 3.6 3.3 | Y C M<br>6.2 6.5 6.4 |
| | Glass transition temp. (°C.) | 58 | 58 |
| Blade | Line pressure of blade (g/cm) | 20.0 | 20.0 |
| Apparatus | Process speed (mm/sec) | 85 | 85 |
| Repetitive copying evaluation | initial | R.B<br>x | R.B.<br>x |
| | 200 sheets | — | — |
| | 1000 sheets | — | — |
| | 5000 sheets | — | — |
| | 10000 sheets | — | — |
| | 50000 sheets | — | — |

Y: yellow, C: cyan, M: magenta

As described in the above Examples 48–51, according to the present invention, there is provided a good full color image without causing the reverse of the cleaning blade or the breakage of the edge portion thereof.

What is claimed is:

1. An image forming method, comprising the steps of:

providing an electrophotographic photosensitive member comprising an organic photoconductor having an average surface roughness of 0.3 to 5.0 microns and rotating at a process speed of 80 mm/sec or larger, charging the photosensitive member, exposing the photosensitive member imagewise corresponding to image information thereby to form thereon an electrostatic latent image, developing the electrostatic latent image with a two-component developer which comprises a dry non-magnetic toner comprising a binder resin having a glass transition point of 60° C. or below, and a magnetic material coated with a resin, thereby to form a toner image on the photosensitive member, transferring the toner image onto a transfer-receiving material, and removing the residual toner remaining on the photosensitive member by an elastomeric blade thereby to clean the photosensitive member, wherein said steps of charging, exposing and developing are repeated plural times to form a multi-color toner image on the transfer-receiving material.

2. A method according to claim 1, wherein the surface of said photosensitive member has an abrasion characteristic of 2.0 or larger according to the Taber's abrasion test.

3. A method according to claim 1, wherein the photosensitive member has an average surface roughness of 0.5 micron or smaller with respect to the direction of the movement thereof.

4. A method according to claim 1, wherein said toner comprises 5.0% by number or more of particles having a particle size of 5.0 micron or smaller in its particle size distribution.

5. A method according to claim 1, wherein said blade exerts a line pressure of 5.0 g/cm to 30.0 g/cm on the photosensitive member.

6. A method according to claim 1, wherein the surface layer of said photosensitive member comprises a coating layer comprising at least a binder resin.

7. A method according to claim 1, wherein the latent image is developed with at least a color toner.

8. A method according to claim 1, wherein said steps of charging, exposing, developing, transferring and cleaning are repeated plural times thereby to form a multi-color toner image on the transfer-receiving material.

9. A method according to claim 1, wherein said steps of charging, exposing and developing are repeated plural times thereby to form a multi-color toner image on the photosensitive member, the multi-color toner image is then transferred onto the transfer-receiving material, and the residual toner is removed by the blade.

10. A method according to claim 1, wherein said steps of at least charging, exposing and developing are repeated three times by using magenta, cyan and yellow toners, respectively.

11. A method according to claim 1, wherein said steps of at least charging, exposing and developing are repeated four times by using magenta, cyan yellow and black toners, respectively.

12. An electrophotographic apparatus comprising:

a photosensitive member comprising an organic photoconductor having an average surface roughness of 0.3 to 5.0 microns and being rotatable at a process speed of 80 mm/sec or larger, charging means for charging the photosensitive member, image exposure means for exposing the photosensitive member corresponding to image information to form an electrostatic latent image thereon, developing means for developing the latent image by using a two-component developer which comprises a dry non-magnetic toner comprising a binder resin having glass transition point of 60° C. or below, and magnetic material coated with a resin, to form a toner image on the photosensitive member, said developing means includes a developing apparatus for effecting color development, transfer means for transferring the toner image onto a transfer-receiving material, and cleaning means for removing the residual toner remaining on the photosensitive member by an elastomeric blade;

wherein said charging means, image exposure means, developing means, transfer means and cleaning means are disposed in this order along the moving direction of the photosensitive member, whereby upon operation of a multi-color toner image is formed on said transfer-receiving material.

13. An apparatus according to claim 12, wherein said developing means includes three or four developing apparatus for effecting full-color development.

14. An apparatus according to claim 13, wherein said three developing apparatus are those for magenta, cyan and yellow colors.

15. An apparatus according to claim 13, wherein said four developing apparatus are those for magenta, cyan, yellow and black colors.

* * * * *